US007793800B2

(12) United States Patent
Griesbaum et al.

(10) Patent No.: US 7,793,800 B2
(45) Date of Patent: Sep. 14, 2010

(54) MULTICOMPONENT CARTRIDGE

(75) Inventors: Gebhard Griesbaum, Sexau (DE); Juergen Gruen, Boetzingen (DE); Clemens Schmidt, Denzlingen (DE)

(73) Assignee: fischerwerke Artur Fischer GmbH & Co. KG, Waldachtal (DE)

( * ) Notice: Subject to any disclaimer, the term of this patent is extended or adjusted under 35 U.S.C. 154(b) by 306 days.

(21) Appl. No.: 11/910,548

(22) PCT Filed: Apr. 11, 2006

(86) PCT No.: PCT/EP2006/003297

§ 371 (c)(1),
(2), (4) Date: Oct. 3, 2007

(87) PCT Pub. No.: WO2006/111297

PCT Pub. Date: Oct. 26, 2006

(65) Prior Publication Data

US 2009/0266843 A1 Oct. 29, 2009

(30) Foreign Application Priority Data

Apr. 16, 2005 (DE) ..... 10 2005 017 599.6

(51) Int. Cl.
*B67D 7/70* (2010.01)

(52) U.S. Cl. ..... 222/137; 222/94

(58) Field of Classification Search ..... 222/137, 222/136, 132, 145.5, 145.6, 94, 129
See application file for complete search history.

(56) References Cited

U.S. PATENT DOCUMENTS

| | | | | |
|---|---|---|---|---|
| 3,266,671 | A * | 8/1966 | Gelpey | 222/94 |
| 3,620,417 | A * | 11/1971 | Simms | 222/136 |
| 3,730,394 | A * | 5/1973 | Woodson | 222/137 |
| 4,801,008 | A * | 1/1989 | Rich | 206/219 |
| 5,405,056 | A * | 4/1995 | Mills | 222/136 |
| 6,634,524 | B1 * | 10/2003 | Helmenstein | 222/94 |
| 2004/0040984 | A1 | 3/2004 | Grossenbacher | |

FOREIGN PATENT DOCUMENTS

| | | |
|---|---|---|
| DE | 39 13 409 | 10/1990 |
| DE | 43 43 985 | 6/1994 |
| DE | 10 207763 | 9/2003 |
| EP | 0 124 852 | 11/1984 |
| EP | 0 340 657 | 11/1989 |
| EP | 0 441 538 | 8/1991 |
| EP | 1 331 174 | 7/2003 |
| FR | 655 134 | 4/1929 |
| GB | 2273918 | 4/1994 |
| WO | 00/27730 | 5/2000 |

* cited by examiner

*Primary Examiner*—Lien T Ngo
(74) *Attorney, Agent, or Firm*—Michael J. Striker

(57) ABSTRACT

The inventive multicomponent cartridge (1) for separately storing and for jointly pressing out at least two components of a free-flowing substance comprises at least one cylinder (2) for holding the substance with at least one pressing plunger (4) for pressing out the substance and at least one outlet (5) for the substance. The components of the substance are stored in separate chambers (8, 9) inside the cylinder (2) that extend in the longitudinal direction of the cylinder (2). An inner area (12) of a film (7) forms a partition (13) of the cylinder (2) between the chambers (8, 9) of the multicomponent cartridge (1). An outer area (11) of the film (7) is integrally joined to the cylinder. According to the inventive method for producing the inventive multicomponent cartridge (1), the outer area (11) of the film (7) is encapsulated during the injection molding of the cylinder (2) for the multicomponent cartridge (1).

6 Claims, 3 Drawing Sheets

MULTICOMPONENT CARTRIDGE

CROSS-REFERENCE TO A RELATED APPLICATION

The invention described and claimed hereinbelow is also described in German Patent Application DE 10 2005 017 599.6 filed on Apr. 16, 2005. This German Patent Application, whose subject matter is incorporated here by reference, provides the basis for a claim of priority of invention under 35 U.S.C. 119(a)-(d).

BACKGROUND OF THE INVENTION

The invention relates to a method for producing a multicomponent cartridge that serves to separately store and coextrude at least two components of a flowable composition, in which the multicomponent cartridge has a cylinder with at least two chambers, separate from one another, for separate storage of the components of the composition. The invention further relates to a multicomponent cartridge for separate storage and coextrusion of at least two components of a flowable composition, having a cylinder for receiving the composition, having an extrusion piston for extruding the composition, and having at least one outlet opening for the composition, the components of the composition being stored separately from one another in at least two chambers of the cylinder that extend in the longitudinal direction of the cylinder of the multicomponent cartridge. The term flowable composition should be understood in particular to mean a pastelike material with pastelike components, such as multicomponent adhesives, multicomponent synthetic resins, or multicomponent mortars.

Cartridges are used for injecting adhesives or sealants and are inserted for this purpose into cartridge presses. For storage and extrusion of two-component composition, cartridges are used that have a cylinder subdivided into two chambers, in which the two components are introduced and stored separately from one another. By means of one or two extrusion pistons, the components located in the chambers can be coextruded, in a predetermined mixture ratio, through the outlet opening. The extruded components are mixed with one another in a static mixer mounted at the outlet opening.

From German Patent Disclosure DE 39 13 409 A1, a two-component cartridge is known which has the shape and construction of an one-component cartridge and can thus be used in conventional cartridge presses for one-component cartridges. For embodiment as a two-component cartridge, one cylinder of the known cartridge is split into two chambers, located side by side, by a flexible partition located in the longitudinal direction and joined by material-locking to the cylinder wall and cartridge wall. Upon extrusion of the components by the extrusion piston, the flexible partition is successively disconnected from the cylinder and cartridge walls and received in a hollow chamber in the extrusion piston.

In German Patent Disclosure DE 102 07 763 A1, a two-component cartridge is disclosed that has two tubular containers separate from one another that extend over sectors of a circle and add up to a full circle, so that the cartridge is in cylindrical form. For the extrusion, the containers are put together and placed in a cylinder of a cartridge press and pressed together in the longitudinal direction by an extrusion piston of the cartridge press.

For long-term storage of as yet unused cartridges, it is necessary that the components be protected against environment factors. This is accomplished as a rule by placing the components in plastic cylinders, whose fill openings and outlet openings are sealingly closed. Conventional cartridges are preferably made from polyolefin plastics. They have only limited barrier properties against diffusion of water into or out of the cartridge, which is either inadequate for hybrid motors or PU systems or requires a thick cartridge wall in order to reduce the water vapor diffusion down to a tolerable amount. In such compositions, the water vapor diffusion plays a decisive role in the durability of the components of the composition that are stored in the cartridge, since one of the components reacts with water, making the composition unusable.

SUMMARY OF THE INVENTION

It is therefore the object of the invention to propose a multicomponent cartridge for separate storage and coextrusion of two or more components of a flowable composition that maximally prevents water vapor diffusion either between the chambers of the multicomponent cartridge or from outside into the cartridge or both, and which can be produced economically. The invention has the further object of proposing a method for producing such a multicomponent cartridge.

The method of the invention for producing a multicomponent cartridge that serves to separately store and coextrude at least two components of a flowable composition, in which the multicomponent cartridge has a cylinder with at least two chambers, separate from one another, for separate storage of the components of the composition, is characterized by the following steps:

a) furnishing a film;

b) placing the film in a longitudinally extending recess in a first part of a mold core of an injection mold for the cylinder of the multicomponent cartridge;

c) inserting a second part of the mold core of the injection mold into the recess in the first part of the mold core, an inner region of the film being located between the two parts of the mold core, and an outer region of the film being located on an outside of the mold core of the injection mold for the cylinder;

d) introducing the mold core with the film into a mold chamber of the injection mold for the cylinder, the outer region of the film being located in the mold chamber of the injection mold for the cylinder;

e) injection molding of the cylinder of the multicomponent cartridge, in which in the filling of the mold chamber of the injection mold for the cylinder with plastic, the outer region of the film is spray-coated and is joined to the cylinder; and f) unmolding of the cylinder of the multicomponent cartridge and removal of the two parts of the mold core from the cylinder.

The cylinder need not have the shape of a geometric cylinder of circular cross section; instead, the cylinder is tubular (for instance it may also be a polygonal tube) of constant cross section over its length.

One possible embodiment of the multicomponent cartridge of the invention has a plastic cylinder, which with a film is subdivided into two separate chambers for receiving two components of a flowable composition. The film is joined to the cylinder in material-locking fashion as a result of the fact that the film is spray-coated with the thermoplastic of the cylinder. For producing a multicomponent cartridge of this kind, in a first work step, a film of a size suitable for the multicomponent cartridge is furnished. The film may be produced in the form of a film blank from a film sheet or a film tube. Next, the film is placed in a longitudinally extending recess in a first part of a mold core of an injection mold for the cylinder of the multicomponent cartridge. To that end, the is expediently removed from the injection mold, and the film is placed in the core outside a mold chamber in the injection mold. In the next work step, a second part of the mold core of the injection mold is inserted into the recess in the first part of the mold core; the second part of the mold core covers part of the film, so that part of the film is located between the two parts of the mold core. Thus an inner region of the film is located between the two parts of the mold core, and an outer region of the film is located on an outside of the mold core of the injection mold for the cylinder of the multicomponent cartridge. The outer region of the film is formed by edges of the film that protrude from the put-together parts of the mold core. The edges of the film can surround the mold core either entirely or in part or can protrude from the mold core. It is also possible for the first or second part of the mold core to be sheathed with a film tube, or to place the edges of a film strip in overlapping fashion around the mold core. Next, the put-together mold core with the film is introduced into the mold chamber in the injection mold for the cylinder, and the injection mold is closed. In the next work step, the mold chamber, surrounding the mold core, of the injection mold is filled with thermoplastic, and the mold core as well as the outer region of the film that protrudes into the mold chamber are spray-coated with plastic, thereby joining the outer region of the film to the cylinder in material-locking fashion. Once the plastic composition has cooled, the cylinder of the multicomponent cartridge is unmolded, and the parts of the mold core located in the cylinder are removed from the multicomponent cartridge. An advantageous feature of the invention provides that in this method, a diffusion-proof film is used.

The multicomponent cartridge of the invention for separate storage and coextrusion of at least two components of a flowable composition has at least one cylinder, which is subdivided by a diffusion-proof film into at least two separate chambers for holding the components. The diffusion-proof film extends over the length of the cylinder; an inner region of the film divides the cylinder into longitudinally extending chambers, and an outer region of the film is spray-coated with the plastic of the cylinder. The outer region of the film is joined to the cylinder in material-locking fashion and separates the components of the multicomponent cartridge that are stored in the chambers from one another. The film forms a diffusion barrier for water and/or water vapor and prevents moisture from entering the chambers and/or leaving the chambers. It also prevents moisture from diffusing from one chamber into another chamber of the multicomponent cartridge. The film may be produced from metal or plastic or other diffusion-inhibiting materials. It is also possible for the chambers of the multicomponent cartridge to be clad entirely or in part by the outer region of the film. As the film, a strip of film or tube of film may be used.

Advantageously, the film has a metal layer as a diffusion barrier. Because of their low water permeability, metals are especially suitable as a diffusion barrier against water vapor. The metal layer preferably comprises aluminum, since aluminum is easy to process and can be procured economically. Aluminum is corrosion-resistant and extensively chemically resistant. Other corrosion-resistant metals may also be used. The film may be made entirely of metal or it may have a metal layer on a substrate material.

An advantageous refinement of the invention provides that the film is made from a composite material. The composite material comprises a first layer of plastic and a second layer, over it, of metal. The first, plastic layer need not necessarily be diffusion-inhibiting, since the metal layer acts as a diffusion barrier. Because of its low water vapor permeability and low cost, an aluminum composite film is especially suitable.

A further advantageous embodiment of the invention provides that the inner region of the film is spaced apart from the cylinder, and the inner region forms a partition extending in the longitudinal direction of the cylinder. The inner region of the film, spaced apart from the cylinder, subdivides the cylinder into side-by-side chambers extending in the longitudinal direction of the cylinder. The chambers thus formed serve to hold different components of the flowable composition. Upon expulsion of the components, the inner region of the film, forming the partition, is pressed from inside against the cylinder or sheared off by the extrusion piston, and the components of the composition are forced through the outlet opening. Crosswise to the cartridge, a circumferential portion of the partition is at least as long as a corresponding circumferential portion of one chamber of the cylinder against which the partition is pressed upon expulsion of the components, so that the partition rests entirely on the cylinder.

Advantageously, the film subdivides the cylinder of the multicomponent cartridge into separate chambers from one another that extend in the longitudinal direction of the cylinder. Depending on the location of the film, the cylinder can be subdivided into two or more chambers. Chambers that are entirely sheathed by the film have especially good diffusion protection.

In a further advantageous feature of the invention, the outlet opening of the multicomponent cartridge has a transverse rib, on which the film is fixed by a front edge. The film is joined in sealing fashion, preferably material-locking fashion, to the transverse rib, which forms an intermediate wall of the outlet opening. The intermediate wall may be embodied in straight or curved form and can protrude with one end into the cylinder. The intermediate wall keeps the components of the composition separate from one another until such time as the components have emerged from the outlet opening. The intermediate wall of the outlet opening expediently extends as far as a front end of the outlet opening, and as a result the chambers of the multicomponent cartridge can be closed in a simple way, for example by screwing a closure cap onto the multicomponent cartridge.

The chambers of the cylinder are preferably closed in sealing fashion by the extrusion piston on the end diametrically opposite the outlet opening. This has the advantage that the chambers of the cartridge can be filled in a single operation, from the end diametrically opposite the outlet opening. Because the fill openings of the chambers are large on this end, filling tubes of large diameter can be used, which shortens the filling time. After filling, the fill openings of the chambers are closed by introducing the extrusion piston. The inner region of the film, spaced apart from the cylinder, is pressed against the cylinder in this process, and as a result the chambers are sealed off from one another. The extrusion piston is expediently embodied such that it does cut into the film as it extrudes the components. This can be achieved by suitable shaping or selection of material for the extrusion piston. It is also possible for the extrusion piston to shear off the film forming the partition, but this involves the risk of lessening the diffusion tightness, particularly between the chambers.

BRIEF DESCRIPTION OF THE DRAWING

The invention will be described in further detail below in terms of an exemplary embodiment shown in the drawings. Shown are.

DESCRIPTION OF THE PREFERRED EMBODIMENTS

Figure 1:
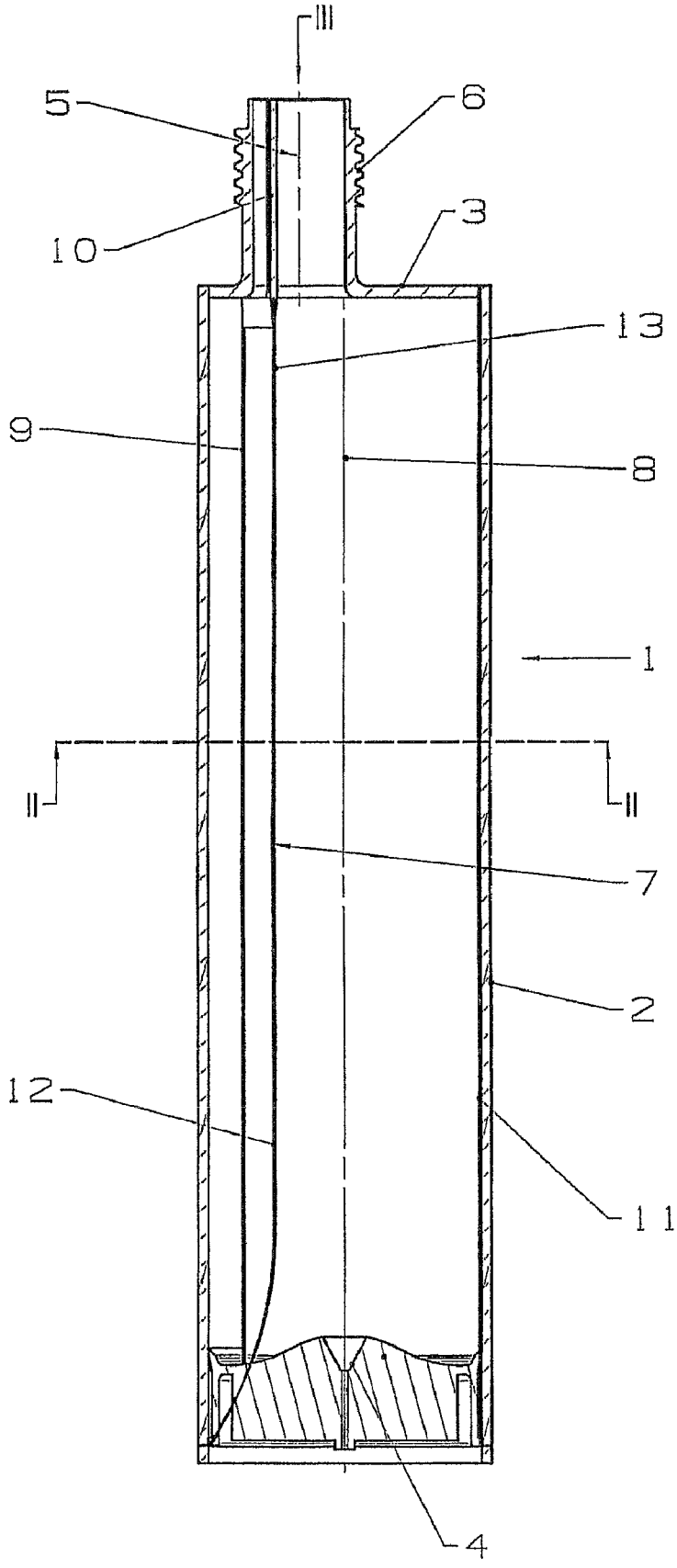
FIG. 1, an axial section through a multicomponent cartridge of the invention.

The multicomponent cartridge 1 of the invention, shown in FIG. 1, is used for separate storage and coextrusion of two components of a flowable composition, and it has a cylinder 2, a top piece 3, and a cylindrical extrusion piston 4. An outlet opening 5 is integrally formed onto the top piece 3 and has a male thread 6 for adaptation of attachment elements, not shown. As attachment elements, for example, a closure cap or a static mixer can be fixed on the male thread 6 of the top piece 3. The cylinder 2 is subdivided by a film 7 into two chambers 8, 9 located side by side. The chambers 8, 9 are used for separately storing different components of a flowable composition, not shown. The film 7 extends over the length of the cylinder 2; an inner region 12 of the film 7 forms a partition 13 between the chambers 8, 9 of the multicomponent cartridge 1. The inner region 12 of the film 7 is spaced apart from the cylinder 2 and is curved in the transverse direction to the cartridge 1. In the transverse direction to the cartridge 1, it has a length that corresponds to the corresponding circumferential portion of the chamber 9 of the cylinder 2.

A transverse rib 10 is located in the outlet opening 5; it extends in the longitudinal direction of the outlet opening 5 and forms an intermediate wall on which the film 7 is sealingly fixed. An outer region 11 of the film 7 is joined by material-locking to the cylinder 2 and completely lines the chamber 8. The extrusion piston 4 presses the film 7, on the end of the multicomponent cartridge 1 diametrically opposite the outlet opening 5, against the cylinder 2 and tightly closes the chambers 8, 9.

The film 7 is diffusion-proof; it prevents diffusion of water vapor between the chambers 8, 9 of the multicomponent cartridge 1. If it surrounds one or both chambers 8, 9 completely, then the film 7 seals off that chamber in diffusion-proof fashion. The film 7 comprises a composite material, with a substrate film of plastic and a metal layer as a diffusion barrier. As the metal, aluminum is for instance employed.

Figure 2:
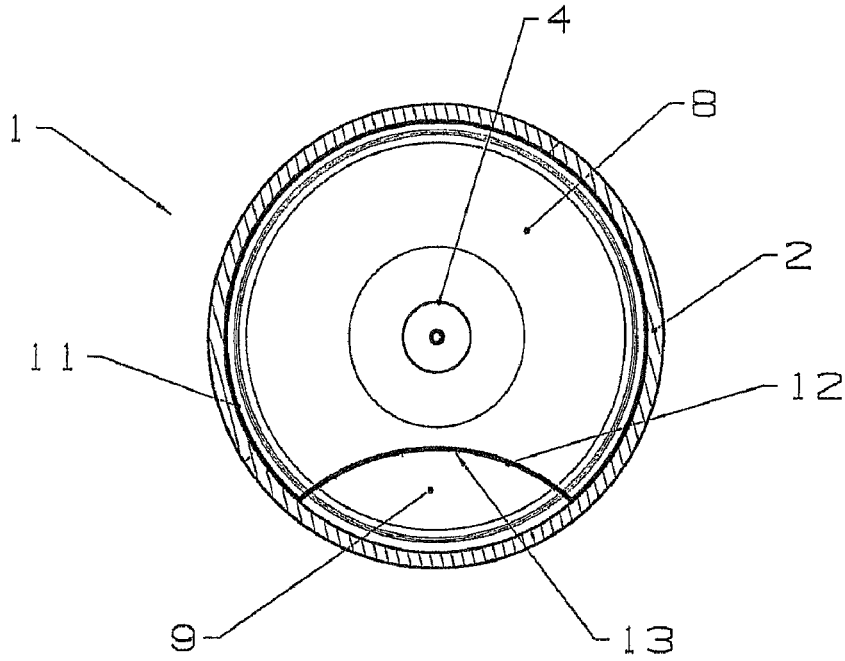
FIG. 2, a cross section of the multicomponent cartridge taken along the line II-II in FIG. 1.

FIG. 2 shows a cross section through the cylinder 2 of the multicomponent cartridge 1 of the invention. The cylinder 2 is subdivided into the chambers 8, 9 by the intermediate wall 13 formed by the inner region 12 of the film 7. The outer region 11 of the film 7 is joined in material-locking fashion to the cylinder 2 and completely lines the chamber 8 of the multicomponent cartridge 1.

Figure 3:
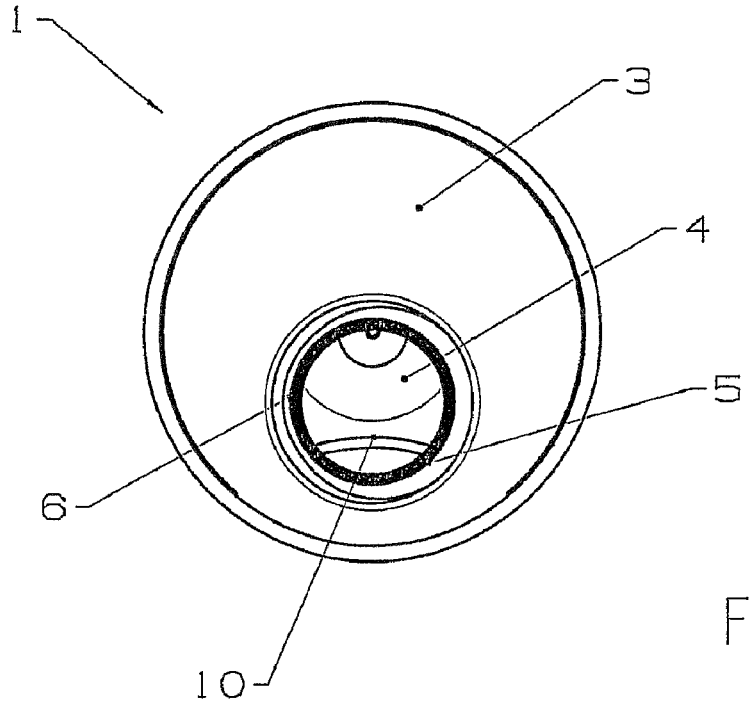
FIG. 3, an end view of the multicomponent cartridge in the direction of the arrow III in FIG. 1.

FIG. 3 shows the multicomponent cartridge 1 of the invention in an end view. The outlet opening 5 is located eccentrically on the top piece 3. The outlet opening 5 is subdivided by the transverse rib 10. The transverse rib 10 is curved like the partition 13; it is offset from an imaginary center axis of the outlet opening 5, and it is aligned with the partition 13 of the cylinder 2.

Figure 4:
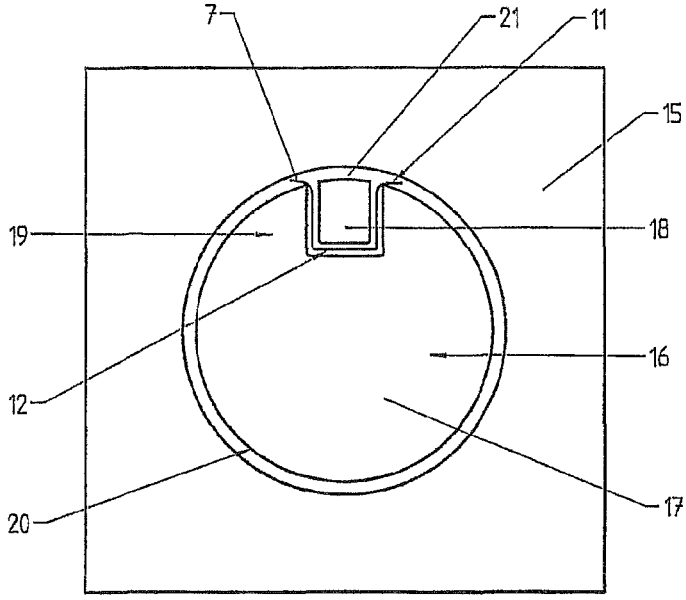
FIG. 4, a schematic illustration of an end view of an injection mold for the method of the invention, with a film protruding from the mold core.
Figure 5:
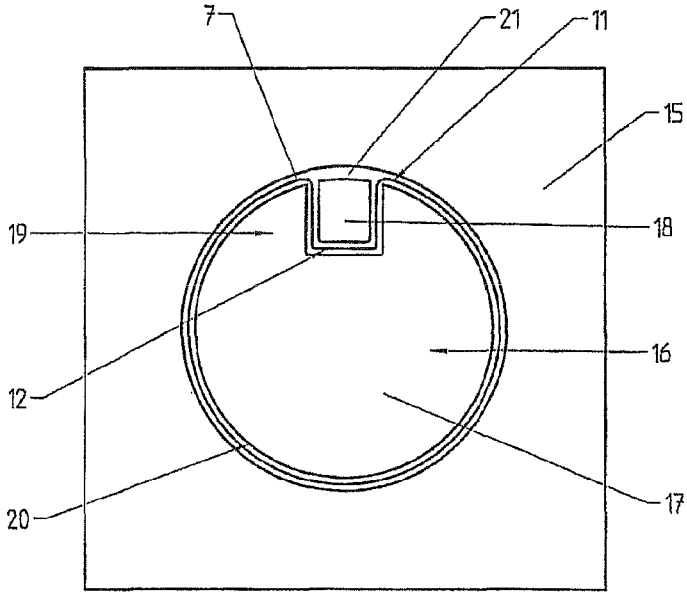
FIG. 5, a further schematic illustration of the injection mold of FIG. 4, with a film surrounding the mold core.

FIGS. 4, 5 schematically show an end view of an injection mold 15 for producing a cylinder 2, not shown, of the multicomponent cartridge 1 as described above, by the method of the invention. A cylindrical mold core 16 is located in a center axis of the injection mold 15 and extends longitudinally of the injection mold 15. The mold core 16 is embodied in two parts and is removable from the injection mold 15. The mold core 16 is divisible and comprises a first part 17 and a second part 18 of the mold core 16; the first part 17 has a longitudinally extending recess 19 for receiving the second part 18. A mold chamber 21 for the cylinder 2 is formed between the mold core 16 and the injection mold 15, extending all the way around an outside 20 of the mold core 16. The film 7 is placed in the recess 19 of the first part 17 of the mold core 16, between the first part 17 and the second part 18 of the mold core 16. An inner region 12 of the film 7 is located between the two parts 17, 18 of the mold core 16, and an outer region 11 of the film protrudes from the mold core 16 into the mold chamber 21 in the injection mold 15.

In the injection molding of the cylinder 2, the mold chamber 21 is filled with thermoplastic, not shown, and the outer region 11 of the film 7 is spray-coated and thus joined in material-locking fashion to the cylinder 2. The two parts 17, 18 of the mold core 16 form open spaces for the chambers 8, 9 of the multicomponent cartridge 1 and, after the cylinder 2 is unmolded, they are removed from the chambers 8, 9 of the cylinder 2. The inner region 12 of the film 7 forms a partition 13 of the cylinder 2 and subdivides the cylinder 2 into the two chambers 8, 9, separate from one another, that serve to hold the components of the composition.

FIG. 4 shows a first advantageous embodiment of the invention, in which the outer region 11 of the film 7 protrudes only slightly from the mold core 16 and is spray-coated on all sides in the injection molding of the cylinder 2. The outer region 11 of the film 7 is completely embedded in the plastic of the cylinder 2 in the process, so that in the multicomponent cartridge 1, only the partition 13 is formed by the film 7.

FIG. 5 shows a further advantageous embodiment, in which the outer region 11 of the film 7 completely surrounds the first part 17 of the mold core 16, and the ends of the outer region 11 overlap. The outer region 11 of the film 7 contacts the outside 20 of the first part 17 of the mold core 16. In the injection molding of the cylinder, the outer region 11 is spray-coated with plastic on the end diametrically opposite the mold core 16, so that one chamber 8 of the cylinder 2 is completely lined with the film 7. The film 7 is preferably diffusion-proof.

The invention claimed is:

1. A multicomponent cartridge (1) for separate storage and coextrusion of at least two components of a flowable composition, having a plastic cylinder (2) for receiving the composition, having an extrusion piston (4) for extruding the composition, and having at least one outlet opening (5) for the composition, the components of the composition being stored separately from one another in at least two chambers (8, 9) of the cylinder (2) that extend in the longitudinal direction of the cylinder (2) of the multicomponent cartridge (1), characterized in that the cylinder (2) has a diffusion-proof film (7), which is composed a material different from the components and different from a material of the cylindrical (2) and extends over the length of the cylinder (2), and an inner region (12) of the film (7) forms a partition (13), which divides the cylinder (2) into the chambers (8, 9) extending in the longitudinal direction, and an outer region (11) of the film comprising a loop that is embedded around it with the plastic of the cylinder (2) and is joined in material-locking fashion to the cylinder (2).

2. The multicomponent cartridge as defined by claim 1, characterized in that the film (7) has a metal layer as a diffusion barrier.

3. The multicomponent cartridge as defined by claim 2, characterized in that the film (7) is made from a composite material.

4. The multicomponent cartridge as defined by claim 1, characterized in that an inner region (12) of the film (7) is spaced apart from the cylinder (2) and forms the partition (13), extending in the longitudinal direction of the cylinder (2), that divides the cylinder (2) into the chambers (8, 9); and that the extrusion piston (4), on extruding the components of the composition, presses the partition (13) against the cylinder (2).

5. The multicomponent cartridge as defined by claim 1, characterized in that the outlet opening (5) has a transverse rib (10), to which the film (7) is fixed.

6. The multicomponent cartridge as defined by claim 1, characterized in that the chambers (8, 9) of the cylinder (2), on the end diametrically opposite the outlet opening (5), are closed in sealing fashion by the extrusion piston (4).

* * * * *